United States Patent [19]

Yanadori et al.

[11] 4,438,692

[45] Mar. 27, 1984

[54] PRINTING APPARATUS WITH COOLING OF HAMMER PRINTING COILS

[75] Inventors: Michio Yanadori, Hachioji; Yuji Hosoda; Isao Nakajima, both of Ibaraki; Kenichi Igarashi; Makoto Kurosawa, both of Katsuta; Kensei Hosoya, Ibaraki; Tsuneki Kobayashi, Mito, all of Japan

[73] Assignees: Hitachi, Ltd.; Hitachi Koki Co., Ltd., both of Tokyo, Japan

[21] Appl. No.: 506,067

[22] Filed: Jun. 20, 1983

Related U.S. Application Data

[63] Continuation of Ser. No. 318,120, Nov. 4, 1981, abandoned.

[30] Foreign Application Priority Data

Nov. 7, 1980 [JP] Japan ..... 55-155973

[51] Int. Cl.[3] ..... B41J 3/00; H01F 5/00

[52] U.S. Cl. ..... 101/93.04; 400/131; 400/157.2; 335/300; 174/16 R; 361/384

[58] Field of Search ..... 101/93.04, 93.05, 93.09, 101/93.48,93; 400/157.2, 131; 335/300; 174/15 R, 174/16 R; 165/54–57, 164–165; 336/61, 62; 361/382–385; 357/82

[56] References Cited

U.S. PATENT DOCUMENTS

| | | | |
|---|---|---|---|
| 2,547,065 | 4/1951 | Wadhams | 336/61 |
| 3,086,457 | 4/1963 | Antonucci | 361/384 X |
| 3,123,743 | 3/1964 | Perlmutter | 174/16 R |
| 3,141,999 | 7/1964 | Schneider | 363/382 |
| 3,230,293 | 1/1966 | Turgeon | 361/384 X |
| 4,014,258 | 3/1977 | Wassermann | 101/93.29 |
| 4,033,255 | 7/1977 | Kleist et al. | 101/93.04 X |
| 4,044,668 | 8/1977 | Barrus et al. | 101/93.04 |
| 4,158,875 | 6/1979 | Tasima et al. | 174/16 R |

OTHER PUBLICATIONS

"Cooling Electrical Equipment", IBM Technical Disclosure Bulletin, vol. 20, No. 6, Nov. 1977, pp. 2428–2429.

"Cooling Apparatus", IBM Technical Disclosure Bulletin, vol. 13, No. 4, Sep. 1970, p. 959.

"Air Cooling Scheme", IBM Technical Disclosure Bulletin, vol. 16, No. 1, Jun. 1973, pp. 296–297.

"Push-Pull Mult-Flow System for Air-Cooled Modules", IBM, vol. 22, No. 2, Jul. 19, 1979, pp. 696–697.

*Primary Examiner*—E. H. Eickholt

*Attorney, Agent, or Firm*—Antonelli, Terry & Wands

[57] ABSTRACT

A printing apparatus including a plurality of drive coils for driving printing hammers arranged longitudinally in side-by-side relation at one side of a core of the U-shape. A first cooling fluid passageway is defined inside the core of the U-shape to allow a cooling fluid for cooling the drive coils to flow therethrough, and a second cooling fluid passageway is defined outside the core by a duct to allow the cooling fluid for cooling the drive coils to flow therethrough without escaping to the outside by diffusion. A current of cooling fluid is forcibly fed into these cooling fluid passageways by a fluid machine.

10 Claims, 9 Drawing Figures

PRINTING APPARATUS WITH COOLING OF HAMMER PRINTING COILS

This is a continuation of application Ser. No. 318,120 filed Nov. 4, 1981.

BACKGROUND OF THE INVENTION

1. Field of the Invention

This invention relates to printing apparatus comprising a printing section including a plurality of drive coils for driving printing hammers arranged longitudinally in side-by-side relation, and more particularly it is concerned with cooling of the drive coils of the printing section.

2. Description of the Prior Art

Printing apparatus of the type described generally comprise a core including a permanent magnet, drive coils located at one side of the core, and printing hammers each having an armature pivoted at one end, part of which constitutes a magnetic circuit. Each of the printing hammers is attracted by the permanent magnet and moves toward the core when no input is applied to the associated drive coil, and when an input is applied to any one of the drive coils, a magnetic field is generated in the magnetic circuit which tends to overcome the magnetic field of the magnetic circuit, to allow the associated printing hammer to be released from engagement with the core. At this time, the printing hammer strikes the paper wound on the platen with a printing pin attached to the printing hammer, to produce characters in the Braille system in patterns composed of raise dots.

The printing hammers are arranged in a plurality of numbers longitudinally of the platen, and the drive coils are equal in number to the printing hammers. The printing section has a longitudinal length of 300 to 600 mm.

In this type of printing apparatus, the drive coils are naturally cooled or forcibly cooled with air. However, as the capacity of the apparatus increases and the printing speed is raised, actuation of the drive coils produces a large amount of heat. Thus, the cooling systems that have been employed in the prior art are unable to meet the requirement of cooling the apparatus of high capacity and high speed operation of the present day.

SUMMARY OF THE INVENTION

This invention has as its object the provision of a printing apparatus which is capable of removing heat therefrom with high efficiency, to enable the capacity of the printing apparatus to be increased and high-speed printing operating to be performed.

The outstanding characteristic of the invention is that cooling medium passageways are formed inside and outside the drive coils of the printing section for forcibly causing a cooling fluid to flow therethrough by a fluid machine, to thereby forcibly cool the drive coils.

DETAILED DESCRIPTION OF THE PREFERRED EMBODIMENTS

Figure 1:
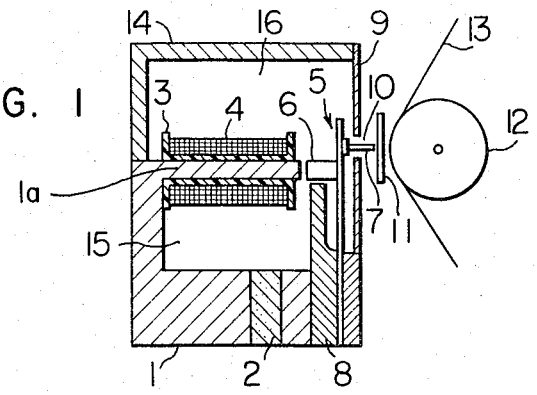
FIG. 1 is a sectional view of a printing apparatus of the prior art, showing its construction.
Figure 2:
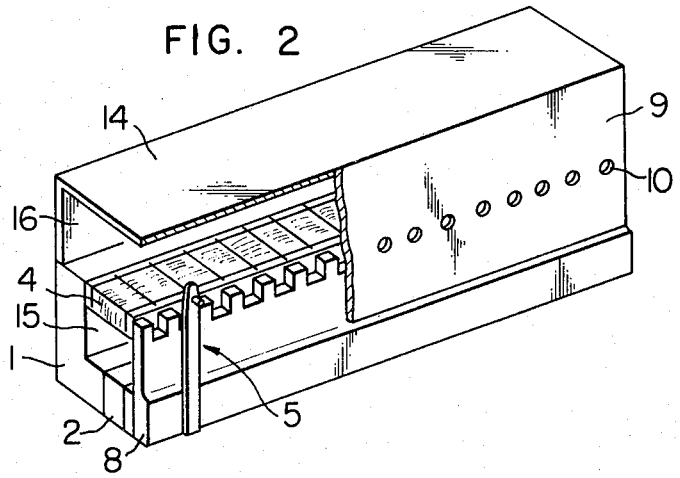
FIG. 2 is a perspective view of a printing section of the apparatus shown in FIG. 1, with certain parts being cut out.

FIGS. 1 and 2 show the principle of the printing apparatus according to the present invention. A core 1 of the U-shape has a permanent magnet 2, and a plurality of drive coils 4, each wound on a bobbin 3, arranged in side-by-side relation in a horizontal core section 1*a*.

Printing hammers generally designated by the reference numeral 5 each include an armature 6 and a printing pin 7 constituting a magnetic circuit together with the core 1, the with the member of printing hammers 5, equal in number to the number of drive coils 4, being arranged side by side to be pivoted on a yoke 8. The printing pin 7 of each printing hammer 5 extends outwardly of a ribbon separator 9 through an aperture 10 formed therein, to outside.

When no input is applied to the drive coils 4, the printing hammers 5 are attracted to the core 1. When an input is applied to any one of the drive coils 4, a magnetic field overcoming the magnetic field of the permanent magnet 2 is generated in a magnetic circuit formed by the core 1, armatures 6 and yoke 8, so that the printing hammer 5 associated with the energized drive coil 4 is released from engagement with the core 1. At this time, the printing pin 7 of the printing hammer 5 strikes through a ribbon 11 a sheet of paper 13 wound on a platen 12, to print a character thereon. This printing apparatus is of the type that prints characters in the Braille system in patterns of raised dots forming a combination, by striking the paper 13 with the printing pins 7.

A duct 14 is mounted on the core 1 in a manner so as to cover the outer surfaces of the drive coils 4, thereby defining a first cooling fluid passageway 15 along the inner surfaces of the drive coils 4 enclosed by the core 1, yoke 8 and drive coils 4 and a second cooling fluid passageway 16 along the outer surfaces of the drive coils 4.

By passing a cooling fluid to flow through the first cooling fluid passageway 15 and the second cooling fluid passageway 16, the drive coils 4 are cooled. At this time, escape of the cooling fluid to outside by diffusion is avoided, thereby contributing to increased cooling efficiency. The direction in which the cooling fluid flows through the first cooling fluid passageway 15 may be the same as the direction in which the cooling fluid flows through the second cooling fluid passageway 16. However, equalization of the temperature of the drive coils 4 can be better achieved by passing the cooling fluid through the two cooling fluid passageways 15 and 16 in countercurrents.

Figure 3:
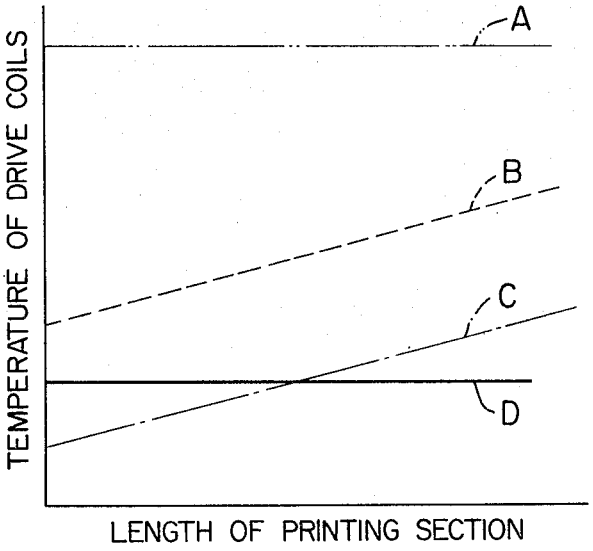
FIG. 3 is a graph showing the results achieved by the printing apparatus according to the invention.

FIG. 3 is a diagram showing the cooling effects achieved by various cooling means. In the diagram, the abscissa represents the length (x) of the printing section, and the ordinate indicates the temperature (T) of the drive coils 4. A two-dots-one-dash line A represents a natural air cooling system of the prior art, a broken line B represents a coil one side forced air cooling system of the prior art, a dash-and-dot line C represents a forced air cooling according to the invention in which the cooling fluid flows in the same direction through the first cooling fluid passageway 15 and second cooling fluid passageway 16, and a solid line D represents a forced air cooling according to the invention in which the cooling fluid in the first cooling fluid passageway 15 and second cooling fluid passageway 16 flow in countercurrents.

In FIG. 3, it will be seen that the forced air cooling according to the invention is capable of reducing the temperature of the drive coils 4 below the level to which the natural air cooling and forced air cooling of the prior art reduce the temperature of the drive coils 4. Particularly, when the cooling fluid is passed through the first cooling air passageway 15 and the second cooling air passage way 16 in countercurrents, it is possible to equalize the temperature of the drive coils 4 arranged in a large number in the longitudinal direction, and it is also possible to unify the electric characteristics of the drive coils 4 and facilitate heat design thereof.

Preferred embodiments of the printing apparatus in conformity with the invention will now be described in detail by referring to FIGS. 4–9.

In each embodiment, the first cooling fluid passageway 15 and the second cooling fluid passageway 16 defined along the inner surfaces and the outer surfaces respectively of the drive coils 4 arranged in a large number in side-by-side relation in the core 1 are constructed such that the cooling fluid passed therethrough flow in countercurrents, so as to increase the effects achieved in cooling the large number of drive coils 4 arranged in side-by-side relation and to equalize the temperature thereof.

Figure 4:
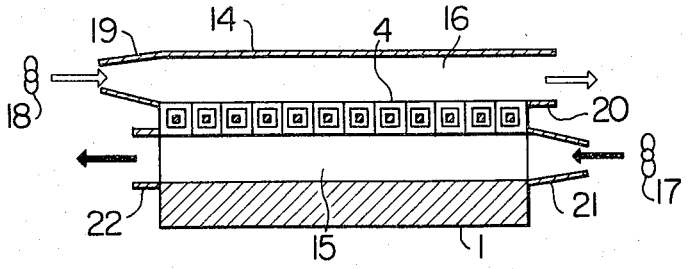
FIGS. 4–7 are sectional views showing the essential portions of preferred embodiments of the invention.

FIG. 4 shows one embodiment in which two fans 17, 18 are employed, with the first fan 17 being used for blowing air blasts into the first cooling fluid passageway 15 in the core 1, and the second fan 18 being used for blowing air blasts into the second cooling fluid passageway 16 provided by the duct 14. An inlet duct 19 is located at the inlet of the duct 14 and an outlet duct 20 is located at the outlet of the duct 14. The core 1 has an inlet duct 21 at the air inlet and an outlet duct 22 at the air outlet.

Figure 5:
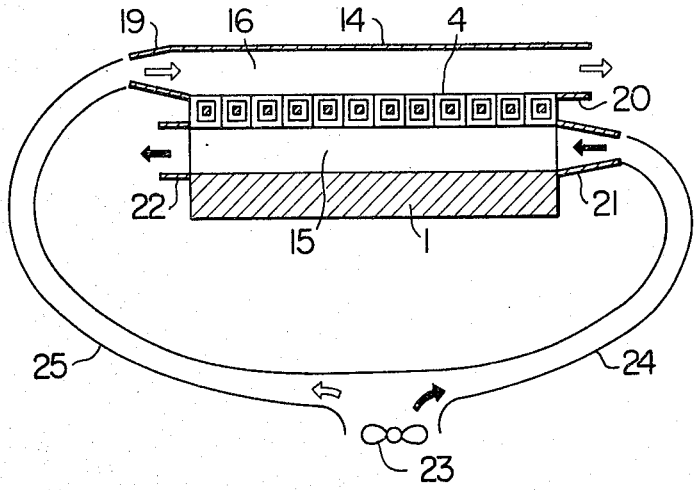

FIG. 5 shows another embodiment in which a single fan 23 is used for blowing air blasts into the first cooling fluid passageway 15 and the second cooling fluid passageway 16. Two bent hoses 24 and 25 extend from the fan 23 in opposite directions and are connected to the air inlet ducts 19 and 21, respectively, to blow an air blast into the two cooling fluid passageways 15 and 16. The fan 23 may be an axial fan or a centrifugal fan. In this embodiment, the first cooling fluid passageway 15 and the second cooling fluid passageway 16 form a system connected together in parallel. However, the invention is not limited to this connection system and the cooling fluid passageways 15, 16 may be connected together in series. When this is the case, one bent hose has only to be employed, thereby facilitating mounting of the parts.

Figure 6:
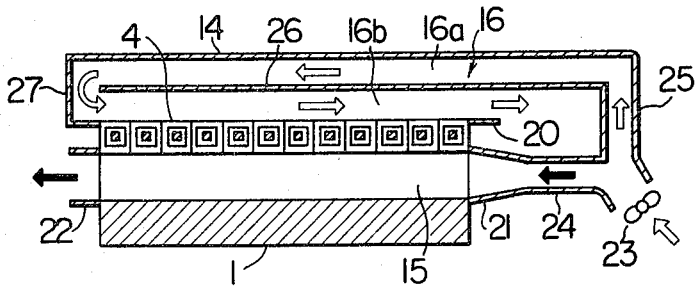

FIG. 6 shows still another embodiment in which the bent hoses 24 and 25 are mounted compactly with ingenuity. As shown, a partition wall 26 is arranged in the longitudinal direction within the duct 14 to divide the second cooling fluid passageway 16 into two cooling fluid passageways **16*a* and 16*b*. A current of cooling fluid led from the bent hose 24 is passed through the first cooling air passageway 15, and a current of cooling fluid led from the bent hose 25 is passed through the cooling fluid passageway 16*a* of the second cooling fluid passageway 16. The current of fluid passed through the cooling fluid passageway 16*a* is caused to change the direction of its flow at the end of the cooling fluid passageway 16*a* at which a U-bend 27 is provided, to be introduced into the cooling fluid passageway 16*b* to cool the drive coils 4**.

Figure 7:
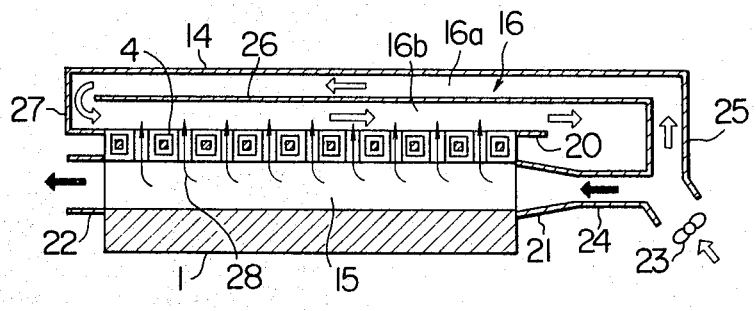

FIG. 7 shows still another embodiment in which a gap 28 is formed between the adjacent drive coils 4 to allow part of the current of cooling fluid from one cooling fluid passageway to flow through the gaps 28 into the other cooling fluid passageway, to enable the capacity of the apparatus to be increased by cooling the drive coils 4 from their side surfaces as well. In the embodiment shown in FIG. 7, part of the current of air flows from the first cooling fluid passageway 15 into the second cooling fluid passageway 16. However, the invention is not limited to this direction of flow of the cooling fluid and the cooling fluid may be made to flow in the reverse direction or from the second cooling fluid passageway 16 into the first cooling fluid passageway 15. A valve (not shown) may be mounted in one of the cooling fluid passageways 15 and 16, bent hoses 24 and 25, inlet ducts 19 and 21, and outlet ducts 20 and 22 to increase the pressure differential between the first cooling fluid passageway 15 and the second cooling fluid passageway 16 by maniplating the valve, to thereby increase the cooling effects.

Figure 8:
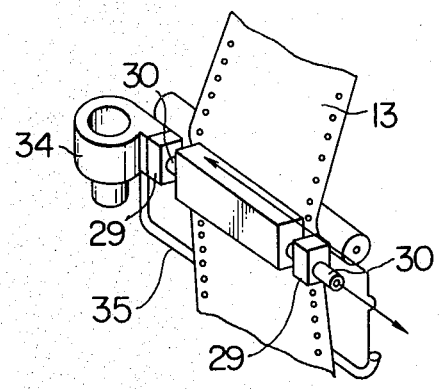
FIG. 8 is a perspective view showing the essential portions of another embodiment of the invention.
Figure 9:
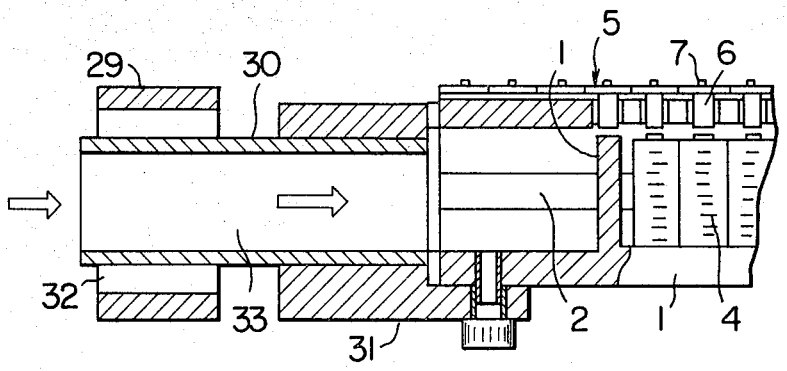
FIG. 9 is a sectional view, on an enlarged scale, of certain portions of the embodiment shown in FIG. 8.

FIG. 8 shows a further embodiment and FIG. 9 shows, on an enlarged scale, the support device portion of the apparatus shown in FIG. 8. The printing section is supported, in actual practice, by a support device 29 at opposite ends, because the printing section is required to move leftwardly and rightwardly when printing of the characters is performed on the paper 13. A guide rod 30 is connected at one end to an end portion of the printing section by a mounting fixture 31 and journaled at the other end by a bearing 32 within the support device 29. The embodiment shown in FIGS. 8 and 9 is characterized in that the guide rod 30 is formed with an air introducing bore 33 therein so as to feed a current of air blown by a fan 34 into the core 1 through the air introducing bore 33.

The use of the guide rod 30 serving concurrently as a cooling fluid passageway enables a compact overall size to be obtained in a printing apparatus. A hose 35 has the function of feeding part of the current of air from a fan 34 to the outer surfaces of the coils of the printing section.

In the embodiment shown and described hereinabove, the cooling effects can be increased by introducing the current of cooling air from the fan in branch currents into the outer side of the core 1 and the outer side of the yoke 8 and blowing same thereagainst.

From the foregoing description, it will be appreciated that in the printing apparatus according to the invention, it is possible to carry out cooling of the drive coils 4 on both sides thereof by a cooling fluid without allowing the cooling fluid to escape to outside by diffusion. Thus the printing apparatus according to the invention can have its capacity increased and its operation speed can also be increased.

What is claimed is:

1. A printing apparatus comprising:

a printing section including a substantially horizontally disposed core, a plurality of drive coils for driving printing hammers arranged longitudinally in a side-by-side relationship at one side of the core, said drive coils being arranged in a side-by-side relationship adjacent to and in contact with one another so as to form a block having a pair of opposite surfaces to be cooled;

a support means for supporting the printing section;

a first cooling fluid passageway defined between one side of said core and one of said pair of opposite surfaces of said drive coils to allow a cooling fluid for the drive coils to flow therethrough, said first cooling fluid passageway having a substantially constant cross-sectional area in a flow direction of a cooling fluid and extending substantially straight in a direction in which the drive coils are arranged;

a second cooling fluid passageway defined between the other of said pair of opposite surfaces of said drive coils and a cover member to allow the cooling fluid for the drive coils to flow therethrough, said second cooling fluid passageway being substantially constant in cross-sectional area in a direction of the flow of the cooling fluid and substantially straight in a direction in which the drive coils are arranged; and at least one fluid machine for forcibly causing the cooling fluid to flow through said first cooling fluid passageway and said second cooling fluid passageway whereby the cooling fluid flows along said opposite surfaces to be cooled of the block of said drive coils.

2. A printing apparatus as claimed in claim 1, wherein said support means includes a hollow guide rod formed with a bore for enabling an introduction of the cooling fluid to the first cooling fluid passageway.

3. A printing apparatus as claimed in claim 1, wherein the cooling fluid passed through said first cooling fluid passageway and said second cooling fluid passageway flow in countercurrents.

4. A printing apparatus as claimed in claim 3, wherein at least two fluid machines are provided, one of said two fluid machines being operative to cause the cooling fluid to flow to the first cooling fluid passageway and the other fluid machine being operative to cause the cooling fluid to flow to the second cooling fluid passageway.

5. A printing apparatus as claimed in claim 3, wherein connecting pipe means are provided for connecting the first cooling fluid passageway and the second cooling fluid passageway in parallel to each other and with the fluid machine.

6. A printing apparatus as claimed in claim 3, wherein connecting pipe means are provided for connecting the first cooling fluid passageway and the second cooling fluid passageway in series with each other and with the fluid machine.

7. A printing apparatus as claimed in claim 3, wherein a partition wall means is mounted in the second cooling fluid passageway for changing a direction of flow of the cooling fluid, and connecting pipe means are mounted on one side for connecting the first cooling fluid passageway and the second cooling fluid passageway in parallel to each other and with the fluid machine.

8. A printing apparatus as claimed in claim 7, wherein means are formed between the adjacent drive coils for communicating the first cooling fluid passageway with the second cooling fluid passageway.

9. A printing apparatus as claimed in claim 8, wherein valve means are mounted at least in one of the first cooling fluid passageway and the second cooling fluid passageway for producing a pressure differential between the cooling fluid flowing through the first cooling fluid passageway and the cooling fluid flowing through the second cooling fluid passageway.

10. A printing apparatus according to claim 1, wherein said first cooling fluid passageway is disposed on an upper side of said drive coils and said second cooling fluid passageway is disposed on the lower side of said drive coils.

* * * * *